United States Patent [19]

Sahasrabudhe et al.

[11] Patent Number: 4,578,754

[45] Date of Patent: Mar. 25, 1986

[54] VEHICLE BRAKE CONTROL APPARATUS AND METHOD

[75] Inventors: Arum P. Sahasrabudhe, Park Dune, India; Habib Dadpey, Upper St. Clair, Pa.; Fernando A. Cirillo, R. Joao De Sousa Dias; Antonia C. Merlo, Sao Paulo, both of Brazil; Pierre A. M. Zuber, Baldwin Borough, Pa.

[73] Assignee: Westinghouse Electric Corp., Pittsburgh, Pa.

[21] Appl. No.: 596,877

[22] Filed: Apr. 5, 1984

[51] Int. Cl.[4] ..... B61L 11/02

[52] U.S. Cl. ..... 364/426; 246/182 B; 246/182 C

[58] Field of Search ..... 364/426, 424, 436; 246/182 R, 182 B, 182 C, 187 R, 187 A, 63 C, 63 R; 303/94, 99, 97

[56] References Cited

U.S. PATENT DOCUMENTS

| | | | |
|---|---|---|---|
| 3,363,096 | 1/1968 | Hughson | 364/426 |
| 3,934,125 | 1/1976 | Macano | 364/426 |
| 4,005,837 | 2/1977 | Grundy | 364/426 |
| 4,005,838 | 2/1977 | Grundy | 364/426 |
| 4,270,716 | 6/1981 | Anderson | 246/182 B |
| 4,384,330 | 5/1983 | Matsuda et al. | 364/426 |
| 4,410,154 | 10/1983 | Matty | 246/182 B |

OTHER PUBLICATIONS

IEEE Annual Meeting, "San Paulo Metro E-W Line Innovations, Costa, 1977, pp. 1105–1109.

*Primary Examiner*—Parshotam S. Lall
*Assistant Examiner*—Thomas G. Black
*Attorney, Agent, or Firm*—R. G. Brodahl

[57] ABSTRACT

The speed of a vehicle is controlled in response to a new speed command lower than a previous speed command such that a safe brake speed profile reference is provided for increasing the average speed of the train in relation to the new speed command and before the new speed command controls the vehicle speed. A sensed vehicle acceleration is compared with a known safe acceleration to determine a speed error and a distance error to establish a critical velocity for the vehicle, which is used to provide an open loop brake control to merge the train speed in relation to a provided safe brake profile before the vehicle speed can again be controlled in relation to the new speed command.

12 Claims, 22 Drawing Figures

VEHICLE BRAKE CONTROL APPARATUS AND METHOD

CROSS-REFERENCE TO RELATED APPLICATION

The present application is related to a patent application Ser. No. 257,681, now U.S. Pat. No. 4,410,154, filed Apr. 27, 1981 by T. C. Matty and entitled "Transit Vehicle Brake Control Apparatus", which is assigned to the same assignee and the disclosure of which is incorporated herein by reference.

BACKGROUND OF THE INVENTION

It is known in the prior art to establish a safe speed profile in relation to the moving cars of a train in accordance with known track conditions, including grades, curves, stations, switches and the like. That profile and the provided track signal block circuits are determined by the track plan layout of the system, and the safe speed profile is employed to determine the command speed for each track circuit. These command speeds are based on worst case calculations of a train going through the track system with one brake failure on the train.

A brake assurance control system was added to the North-South line of Sao Paulo, Brazil, as set forth in a published article entitled "Sao Paulo Metro E-W Line Modifications" in the Conference Record of the IAS Annual Meeting of the IEEE Industry Applications Society for October 1977. An accelerometer was put on the car for operation with the brake control system in relation to the tachometer output and the change of commanded speed. The safe velocity profile determination utilized the commanded speed, the accelerometer output and information from the brake lines. A mathematical model of deceleration versus time was established, assuming various time delays in applying this deceleration, and desiring the brake rate to be minus 1.0 meter per second squared. The train deceleration rate from this model was compared with the output of a pendulum accelerometer to compute the deceleration error. The deceleration error was integrated assuming zero initial conditions, to give velocity error, and the velocity error was integrated assuming zero initial conditions to give the distance error. Each of these errors was compared with a respective reference threshold and if it got within a predetermined tolerance, the brake control applied the brakes, and the automatic train control equipment opened the speed control loop to result in the train losing system throughput performance.

SUMMARY OF THE INVENTION

A vehicle brake profile monitor apparatus provides an extended closed loop speed control of the vehicle in accordance with a determined safe brake speed profile reference for improving vehicle performance and increasing the vehicle movement average speed. In response to a decrease in the input command speed, a previously determined safe vehicle deceleration rate is compared with a sensed vehicle deceleration rate from an accelerometer, with the difference being integrated to provide a velocity error that is used to provide a vehicle safe brake speed profile for controlling the vehicle speed in relation to this reference safe brake speed profile. This velocity error is compared to a reference velocity to establish when the brakes must be applied in open loop control in order to maintain the vehicle safety.

When the resulting actual deceleration compares with the desired safe deceleration, then closed loop speed control of the vehicle is provided in relation to the safe brake speed profile. A plurality of vehicle deceleration profiles are provided to respectively determine different braking operations in accordance with the velocity error of the vehicle.

DESCRIPTION OF A PREFERRED EMBODIMENT

Figure 1:
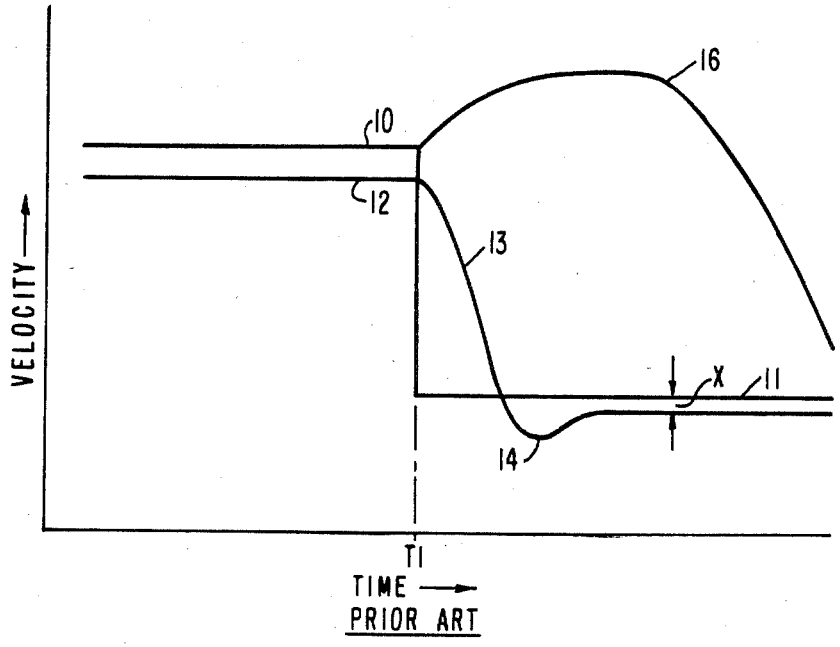
PRIOR ART FIG. 1
In FIG. 1 there is illustrated the operation of a first prior art open loop speed control system.

In FIG. 1 there is illustrated the operation of a first prior art speed control apparatus, which responds to the actual vehicle speed being greater than the desired command speed as an overspeed condition of operation to open the speed control loop and apply the brakes to drop the actual speed to a desired margin below the new command speed. If at time T1 the input command speed 10 changes to a new value 11 below the actual speed 12, the speed control system at time T1 would open the speed control loop and apply the service brakes such that the vehicle actual speed 12 would ramp down at a jerk-limited rate 13 until the actual speed 12 after a small undershoot 14 again becomes some desired difference value X below the new value 11 of the command speed. The well-known predetermined safe brake profile 16 is established in accordance with the track system plan.

Figure 2:
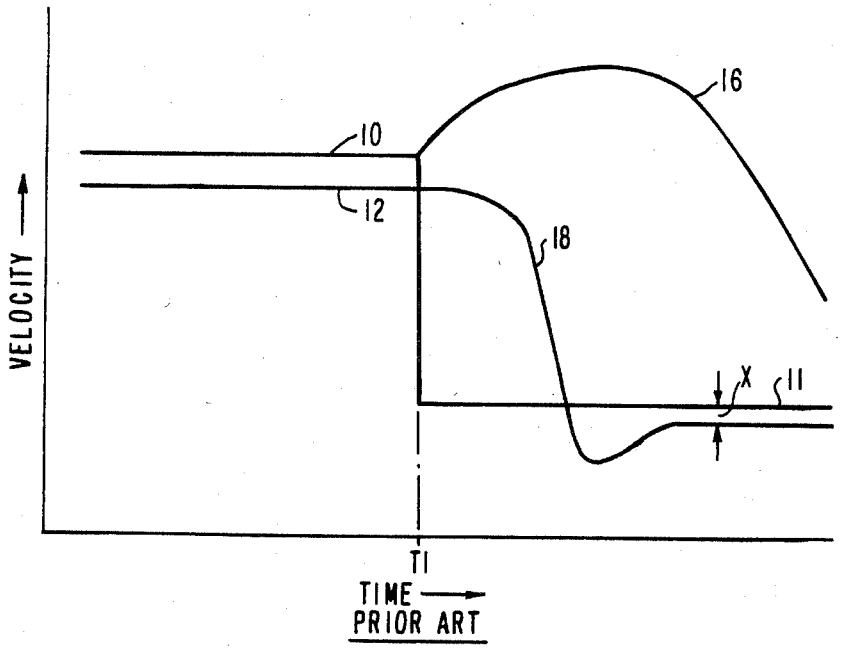
PRIOR ART FIG. 2
In FIG. 2 there is illustrated the operation of a second prior art speed control system.

In FIG. 2 there is illustrated the operation of a second prior art brake assurance speed control, wherein an accelerometer is provided on the vehicle to sense the net actual acceleration of the vehicle. A theoretical vehicle acceleration is calculated with a model equation in relation to the tachometer actual speed signal 12, the change of input command speed 10 to a new reduced value 11 of command speed and various known time delays for the vehicle to change from power to brake operation. Each of the sensed acceleration and the calculated acceleration is integrated assuming zero initial conditions to give a sensed velocity and a calculated velocity, with the difference therebetween being the velocity error of the vehicle. Each of the sensed velocity and the calculated velocity is integrated assuming zero initial conditions to give a sensed distance and a calculated distance, with the difference therebetween being the distance error of the vehicle. The vehicle brake control is established to provide the actual speed curve 18 to keep this distance error below a predetermined and desired value. The actual speed curve 12 is seen in FIG. 2 to ramp down at a jerk-limited rate in accordance with curve 18 until the actual speed is some desired difference value X below the new value 11 of the input command speed. The accelerometer provided with this prior art speed control operated to provide an assurance sensing of the actual braking of the vehicle, and should the normal brakes not be operating satisfactorily for some reason, an independent set of standby brakes is applied to decelerate the vehicle as desired. The P signal line and the brake line are already open at this time through operation of the normal speed maintaining control system.

Figure 3:
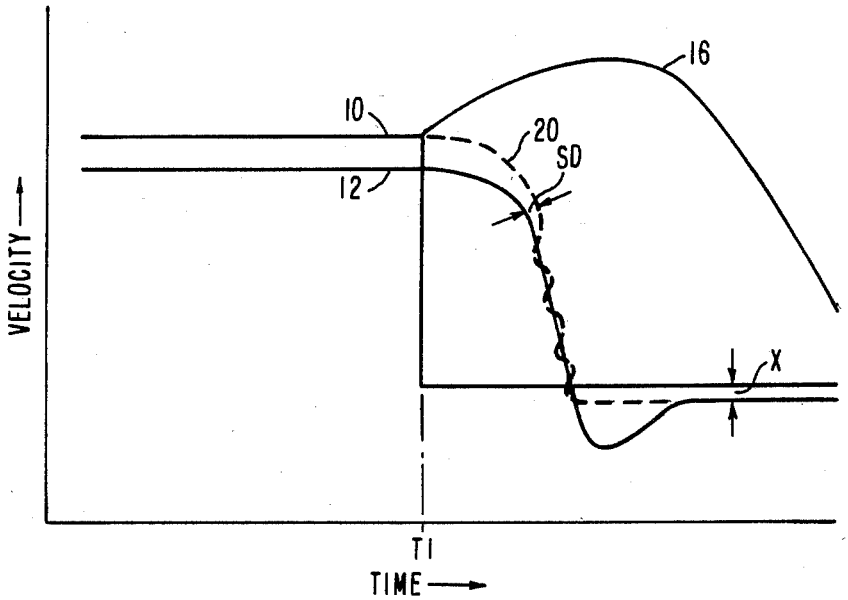
PRIOR ART FIG. 3
In FIG. 3 there is illustrated the operation of a third prior art speed control system.

In FIG. 3 there is illustrated the operation of a third prior art speed control system, as disclosed in the above-referenced patent application Ser. No. 257,681 now U.S. Pat. No. 4,410,154, wherein a maximum safe velocity is determined for each time interval $\Delta T$ in relation to the previous maximum safe velocity minus the product of a ratio of the actual speed to the previous maximum safe velocity times the difference between the track system determined required deceleration minus the vehicle inertial deceleration rate plus the vehicle wheel measured deceleration rate. In this way a maximum safe velocity profile 20 is established, and the speed control permits the actual speed 12 to continue as shown in FIG. 3 until the actual speed 12 approaches within a predetermined speed difference SD to the maximum velocity profile 20. When the actual speed 12 approaches closer than this difference SD or even crosses the threshold profile 20, the emergency brakes are applied. The maximum safe velocity profile 20 is determined for each control system computer cycle of operation, using as one of the initial conditions the previously determined maximum safe velocity parameter. The calculated maximum safe velocity parameter 20 is then given to the speed maintaining control apparatus for establishing the actual velocity of the train vehicle for the next time interval of the control computer cycle of operation.

Figure 4:
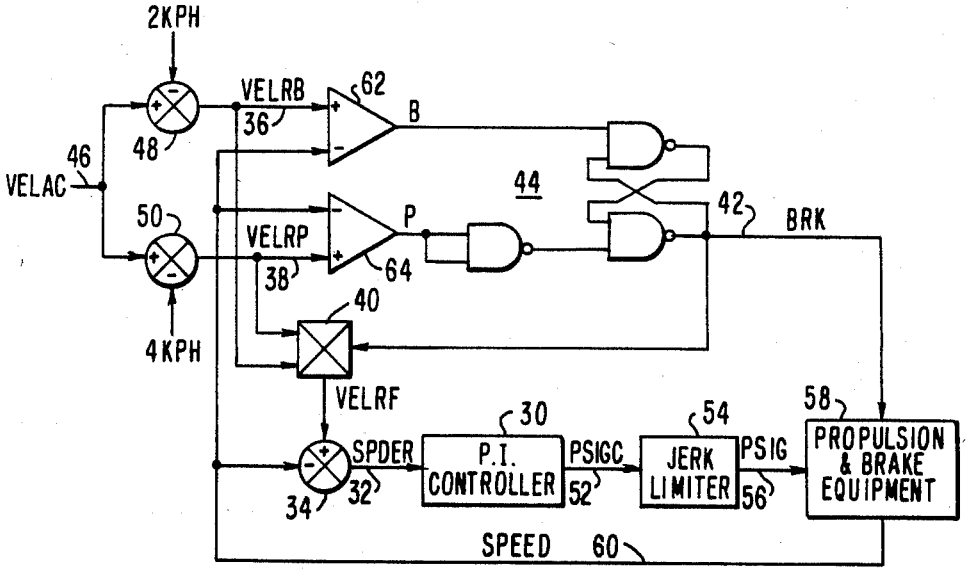
PRIOR ART FIG. 4
In FIG. 4 there is shown a functional schematic of a prior art speed maintaining control apparatus.

In FIG. 4 there is shown a well-known functional schematic of a prior art speed maintaining control apparatus for a transit vehicle, including a proportional and integral controller 30 which responds to a speed error signal 32 from a comparator 34 responsive to one of a brake reference velocity signal 36 or a power reference velocity signal 38 through operation of a selector 40 that responds to the brake mode or the power mode control signal from output 42 of a power brake controller 44. An input action velocity or command speed signal 46 is supplied to a first comparator 48, which provides the brake reference velocity signal 36 as 2 KPH below the value of the action velocity signal 46 and is operative with a comparator 50 which provides the power reference velocity signal 38 as 4 KPH below the action velocity signal 46. The PI controller 30 provides an output first effort request P signal 52 to a jerk limiter 54 which provides an output second effort request P signal 56 to the propulsion and brake equipment 58, including the propulsion motor of a transit vehicle. The output signal 42 from the power brake controller 44 is either a brake mode control signal having a zero value or a power mode control signal having a one value. The actual speed 60 of the vehicle is fed back as an input to the power brake controller 44. When the actual speed 60 is above the brake reference velocity VELRB signal 36, the comparator 62 provides an output to cause the power brake controller 44 to provide the brake mode control signal to the propulsion and brake equipment 58. When the actual speed signal 60 is less than the power reference velocity VELRP signal 38, the comparator 64 provides an output signal 42 to the power brake controller 44 such that the power mode control signal is supplied to the propulsion and brake equipment 58.

In the typical speed maintaining control operation of a transit vehicle, particularly while the vehicle is going along a roadway track grade and with a prior art speed control apparatus, the speed control will respond to an increase in the vehicle speed 60 above the brake reference velocity 36 to provide a brake mode of operation and the difference between the brake reference velocity and the vehicle speed 60 as determined by the comparator 34 will determine the P signal 56 during this brake mode operation. The speed control will respond to the decrease in the vehicle speed below the power reference velocity 38 to provide the power mode of operation and the difference between the power reference velocity 38 and the vehicle speed 60 as determined by the comparator 34 will determine the P signal 56 during this power mode operation. The speed maintaining control operation will oscillate back and forth in this manner between the brake mode and the power mode as the transit vehicle moves along the roadway track. The desired vehicle speed profile for the roadway track is determined by speed code information provided to the respective track circuits in the form of command speed codes. The speed maintaining control apparatus including a PI controller performs the vehicle speed maintaining function in response to a given track circuit input command speed 46 to determine a power mode and a brake mode of operation within that track circuit. The characteristics of the power and brake controller output signal 42 are such that if this signal is a logic one the train vehicle will be in the power mode and if this signal is a logic zero the train vehicle will be in the brake mode.

Figure 5:
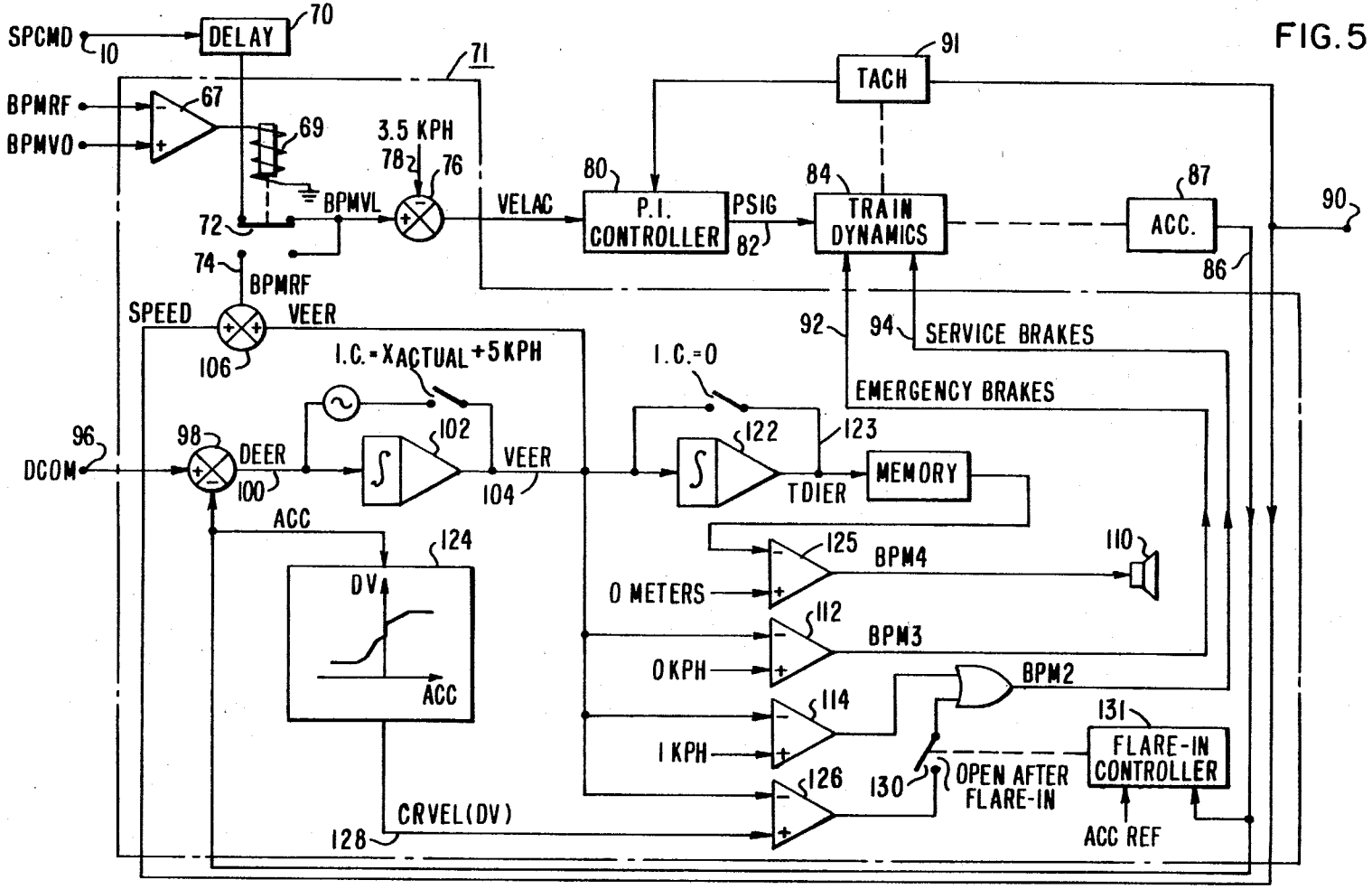
In FIG. 5 there is functionally illustrated the brake profile monitor control apparatus and method of the present invention.

In FIG. 5 there is functionally illustrated the brake profile monitor apparatus and method in accordance with the present invention, which responds to a change in the input speed command 10 from a higher speed command to a lower speed command. There is a delay of time TD before that speed command change is recognized by the train vehicle, as represented by the time delay block 70. A programmed microprocessor is provided to perform the functional operations shown within the brake profile monitor control apparatus 71. When the new speed command 10 is less than the old speed command, after the delay 70, the control system starts generating the BPM safe reference profile velocity 74. When this BPM profile velocity 74 shown as BPMRF is greater than the old speed command shown as BPMVO, the comparator 67 energizes the relay 69 to hold the contact switch 72 in the upper position and the old speed command 10 is applied as an input to the action velocity comparator 76. When the BPM reference velocity 74 is equal to or less than the previous speed command 10, then the relay 69 releases the contact switch 72 to be positioned down and the BPM profile velocity 74 is used as an input to the action velocity comparator 76. When in BPM operation, the speed offset 78 is subtracted from the BPM reference to generate VELAC 79, which action velocity 79 goes to the PI controller 80 to provide the P signal 82 which establishes the effort request to the train propulsion and brake equipment 84. The train acceleration 86 is sensed by a pendulum accelerometer 87 and the train speed 90 is sensed by a tachometer 91. The train propulsion and brake equipment 84 has two additional inputs, emergency brakes 92 and service brakes 94. The service brakes 94 are the normally utilized air pressure operated brakes. The emergency brakes 92 can be provided with increased air pressure for the air pressure operated brakes and are utilized when desired.

The input 96 represents the desired deceleration rate or constant, such as one meter per second squared for the worst case system parameter of the well known safe brake profile 16 shown in FIG. 1. The actual deceleration 86 is sensed by the pendulum accelerometer 87 carried by the train and compared with the desired deceleration input 96 by the comparator 98 to determine the deceleration error 100, which is then input into an integrator 102 to determine the velocity error 104. An integration needs an initial condition, which in this case is the actual speed error plus 5 KPH. The actual speed error equals the speed command 10 minus the speed 90 of the train, and to that is added the 5 KPH offset. The integrator 102 computes velocity error 104. At summer 106 the velocity error 104 is added to the tachometer speed 90 to establish the projected BPM safe brake velocity profile 74, which is in effect the maximum allowed safe vehicle speed as a function of time and this determination is made at a microprocessor cycle time of 18 times each second.

Figure 6:
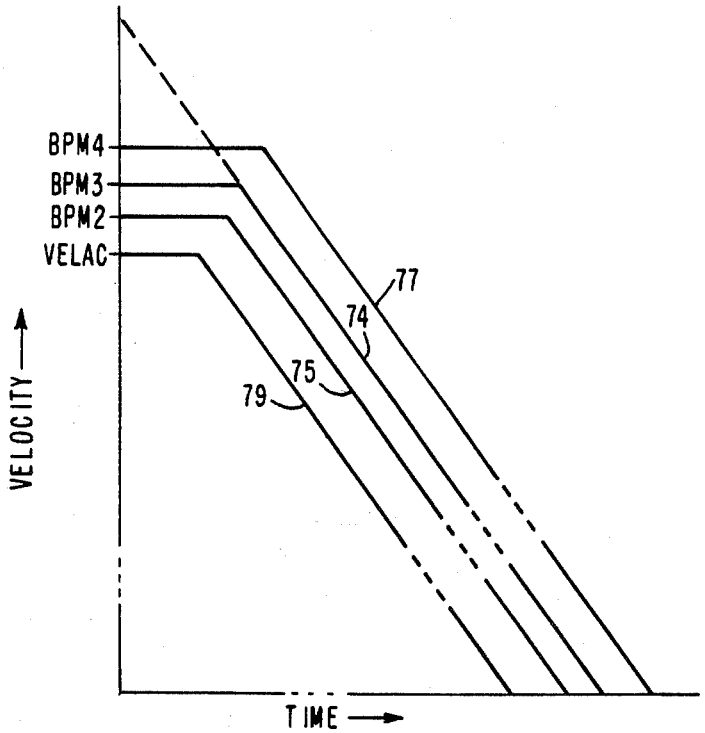
In FIG. 6 there is shown the plurality of speed control profiles provided by the FIG. 5 operation; and In FIG. 7 there is illustrated the operation of the present brake control to merge the vehicle speed in relation to a desired reference safe speed profile.

In FIG. 6, there are shown the plurality of speed control profiles that are provided by the present vehicle brake control apparatus, including the generated safe brake velocity profile 74, a second brake velocity profile 75 that has a 1 KPH difference below the generated profile 74 and a third brake velocity profile 77 that has a 1.5 KPH difference above the generated profile 74.

In comparator 112 a comparison is made of velocity error 104 with zero KPH to see if the train speed 90 is greater than the generated brake velocity profile 74, and if that is not satisfactory, there is applied the retrievable braking operation that is done by actuating the emergency brake 92 at a 1.5 meter per second squared brake rate. In addition, in comparator 114 a comparison is made of the velocity error 104 with a predetermined value of positive 1 KPH to see if the train speed 90 is greater than the generated brake velocity profile 74, and if yes the service brakes 94 are applied to brake the train at a 1.2 meter per second squared brake rate. The BPM2 operation with the service brakes 94 functions to change the train operating mode from power to brake and provides maximum service brakes. The integrator 122 determines the credit distance TDIER 123 to establish with comparator 125 when the operator must actively stop the train.

Figure 7:
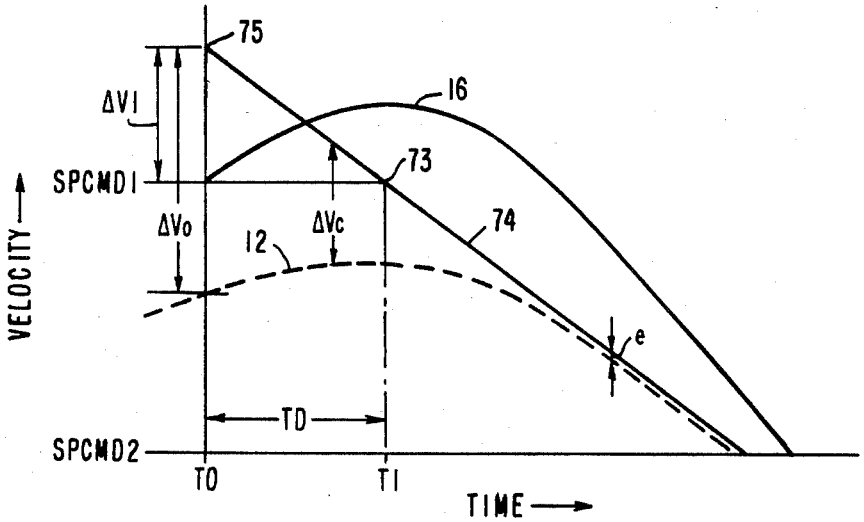

In FIG. 7 there is illustrated the operation of the brake control apparatus and method of the present invention, whereby more vehicles are able to pass safely through a particular track system in a given period of time. This is accomplished by extending the closed loop speed control operation to improve the vehicle speed control to approach a predetermined speed difference closer to the track system determined safe brake speed profile 16. As brake failures occur on a train of one or more vehicles, this will reduce the stopping ability of the train and require an increased difference margin away from the track system determined safe speed profile curve 16. There is in practice not enough time available to generate the safe speed profile 16 in real time aboard the vehicle, and the required input data information to do this is not available for real time control purposes. The safe speed profile 16 is provided off-line in relation to one brake failure on the train and a constant deceleration rate of 1.0 meters per second squared independent of grade. The safe speed profile 16 does include a consideration for the track grade, and if the actual vehicle speed control does satisfy the threshold of the safe speed profile 16, the track grade is not a required consideration.

After a change in the command speed reference from SPCMD1 as shown in FIG. 7, the speed values from the curve 74 are given as distance-related speed references to the regular speed maintaining control apparatus, and an effort is made to keep the vehicle actual speed 12 within a predetermined offset with the curve 74, such as 3.5 kilometers per hour, until the vehicle actual speed 12 again becomes within a desired relationship with the new command speed reference SPCMD2 for the speed maintaining control operation.

As shown in FIG. 7, the operation of the present brake profile monitor control apparatus 71 for a train moving along a track at speed V in response to a track speed command SPCMD1 becomes active when the track speed command code changes from SPCMD1 to a lower value SPCMD2, requesting a lower speed for the train and operating to assure a safe braking distance. The brake profile monitor apparatus 71 is provided to effect a safe reduction in vehicle speed when required, and in addition to use the vehicle speed safety margins to improve the performance of the vehicle in relation to passenger comfort and to result in reduction of propulsion-brake mode changes and associated equipment wear. In the determination of the BPM brake profile 74, there is a delay time td between the time t1 at which the brakes are applied, and the time to when a new speed code SPCMD2 is recognized by the vehicle. This time delay exists because the vehicle cannot immediately apply its brakes due to the brake reaction time involved. The BPM safe brake velocity profile 74 begins from a point 75 which is $\Delta V1$ above the commanded speed SPCMD1, with the difference $\Delta V1$ being a constant offset value independent of the speed code transition values and which value is adjusted so that for any situation involving vehicle movement, the speed profile 74 generated by the BPM system will always be below the track system determined safety profile 16. The BPM speed profile 74 has an inclination angle of a+ag depending upon the track grade.

To merge the train movement curve 12 with the desired BPM safety envelope 74, two parameters must be calculated:

a. The critical velocity when braking must start, which is indirectly calculated through the critical-speed error ΔVc, defined as the minimum speed-error from which the train must start braking, and b. The deceleration value to be applied to the train is calculated every 1/18 sec as a function of the speed-error that occurs and the actual speed.

As shown in FIG. 7, a ΔVc is the minimum critical velocity error that is allowed from a time to where the train must begin braking such that the train movement curve 12 will satisfactorily merge with the BPM curve 74.

Figure 8A:
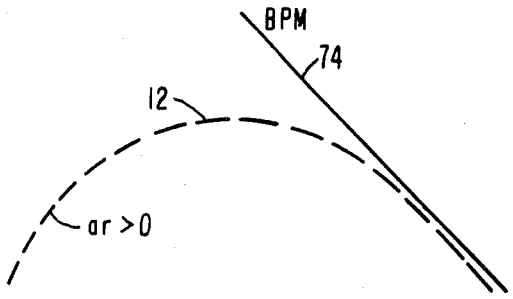
In FIGS. 8A, 8B, and 8C there are shown the three speed merge control operations provided by the present invention.
Figure 8B:
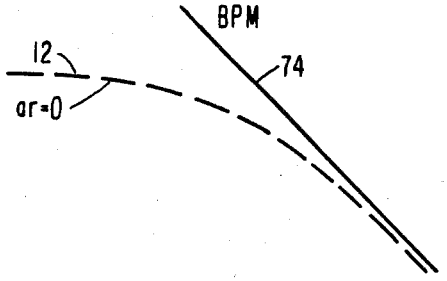
Figure 8C:
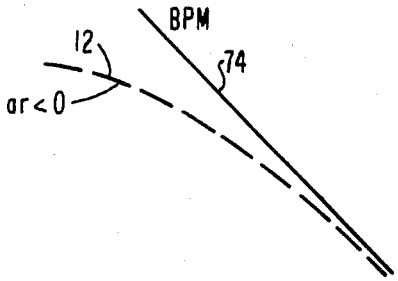

ΔV1—BPM curve 74 starting point offset
ΔVc—critical speed-error
a—brake model acceleration
ag—grade acceleration component
SPCMD1—old speed command
SPCMD2—new speed command
e—desired speed offset
td—delay time
to—BPM curve 74 starting time The three vehicle movement conditions to consider when the vehicle speed 12 merges with the BPM speed profile 74 are shown in FIGS. 8A, 8B and 8C. In FIG. 8A the vehicle acceleration ar is greater than zero, in FIG. 8B the vehicle acceleration ar is equal to zero and in FIG. 8C the vehicle acceleration ar is less than zero, in relation to the BPM speed profile 74.

Figure 10:
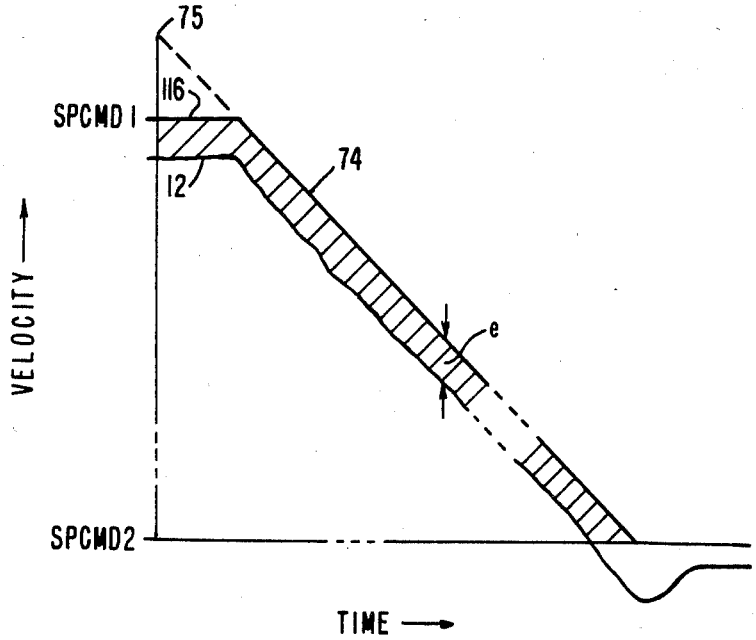
In FIG. 10 there is shown the travel distance of the train in relation to the credit distance.

As shown in FIG. 7 when all the integrations are started there is a fictitious speed offset ΔV1, providing an upper area between the top 75 of the 5 KPH offset to the point 73 where the speed command SPCMD1 and the BPMRF projected profile 74 meet, since the train does not operate in that upper area. When the projected profile 74 has come down enough to the point 73 where the speed command SPCMD1 and the BPM profile 74 are equal, this is the train speed condition where the BPMRF 74 is less than or equal to the old speed command and then the BPMVL signal 116 becomes the same as the BPMRF signal 74. As time goes by, the generated BPMRF 74 minus BPMVϕ or old speed command becomes smaller and eventually becomes zero because the projected profile 74 is coming down, and when this difference becomes zero, the switch 72 is moved down. This computation for the distance error represents the distance not yet traveled by the train or the credit distance, with the distance error being the distance between the actual speed 12 and the brake profile 74. If the speed profile 12 crosses the brake profile 74, the velocity error 104 changes in sign, and if the velocity error 104 is then further integrated by the integrator 122, this operation will debit the distance error from the credited distance error as shown in FIG. 10 to establish the remaining net between the credit distance and the debit distance. If the vehicle speed 12 stays below the BPM brake profile 74, there will always be a credit. If the speed 12 goes across the brake profile 74, the credit distance 123 will stop increasing and begin to decrease, and when the credit distance 123 reaches zero as sensed by comparator 125, or some predetermined number greater than zero if a minimum credit distance is desired, the audio alert 110 will sound and the operator must take active measures to stop the train such as applying the redundant non-retrievable emergency brake and sanding the rail to increase adhesion.

Figure 9:
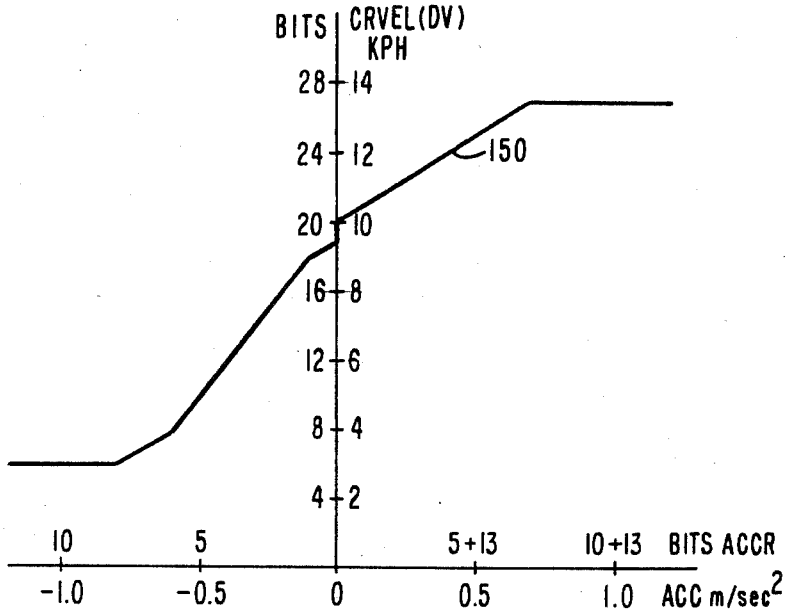
In FIG. 9 there is shown the critical velocity as a function of acceleration that is utilized to control the merge of the train speed in relation to the BPM deceleration profile.

The block 124 anticipates merging the speed 12 into the safe brake speed profile 74 in accordance with a predetermined relationship between the computed velocity error 104 and the output 86 of the accelerometer to establish a critical velocity ΔVc shown in FIG. 7. In FIG. 9 there is shown an illustration of the critical velocity versus acceleration curve 150 which relationship is stored in memory and is utilized during the transient condition when the train speed 12 merges into the BPMRF profile 74 as shown by FIGS. 8A, 8B and 8C. The non-linear function in FIG. 9 determines when the BPM 2 service brake action by the comparator 126 is initiated over conductor 94 to cause the train speed 12 to decrease and then merge with the BPMRF profile 74 without an overspeed condition and maintaining the desired offset e shown in FIG. 7. If the speed error 104 shown in FIG. 5 is less than or equal to the critical velocity 128, the BPM 2 action is provided by closing the switch 130. The acceleration 86 determines the reading of critical velocity 128 from the curve 150 shown in FIG. 9 and the critical velocity 128 is then compared with the determined velocity error 104 in the comparator 126. The switch 130 is opened by the flare in controller 131 after the flare-in operation. The BPM 2 operation over conductor 94 provides the service brake mode for the train, and this activity will occur earlier for a train going at a high acceleration as compared to a train going at a low acceleration.

In FIG. 10 there is shown the BPMRF profile 74 in relation to the former input speed command SPCMD1 and the new speed command SPCMD2. The BPMVL profile 116 is shown. The integrated area below the actual speed curve 12 represents the total distance the train is allowed to travel with the desired speed offset (e). The integrated area between the actual speed curve 12 and the BPMRF profile 74 represents the credit distance TDIER that is normally not traveled.

The BPM profile is not active on a speed-up command, since it is desired for the train speed to increase to the new speed command as fast as can be reasonably done. The BPM profile is active on a down speed command, which is from higher speed to a lower speed, and it improves performance by braking much later so each train gets through the track system faster. The train tries to follow the BPM profile and keeps monitoring its operation by feeding back the acceleration. The BPM profile that is generated for the train to follow is independently coming down at a preset rate, so this is a time dependent profile. If the train is already speed maintaining in relation to the previous and higher speed command, once a new and lower speed command is provided, the train is already at the critical speed and the BPM 2 braking starts immediately. If the train is not in the speed maintaining region and is still accelerating and a down speed code is received, there is no reason to start braking at this time if the train still has a considerable safe distance margin, so the train keeps accelerating until it reaches the critical speed, which critical speed is the speed at which the train has to start braking so, by the time all of the delays in the system has passed, the train speed will merge into the BPM profile curve and does not overshoot the BPM curve. It is assumed that there are available two or three different kinds of braking modes on the train, such as service brakes, emergency brakes and auxiliary operator operated track brakes. The BPM control takes open loop brake action until speed maintaining can resume in relation to the profile 74 and then the open loop brake action is removed.

Figure 11A:
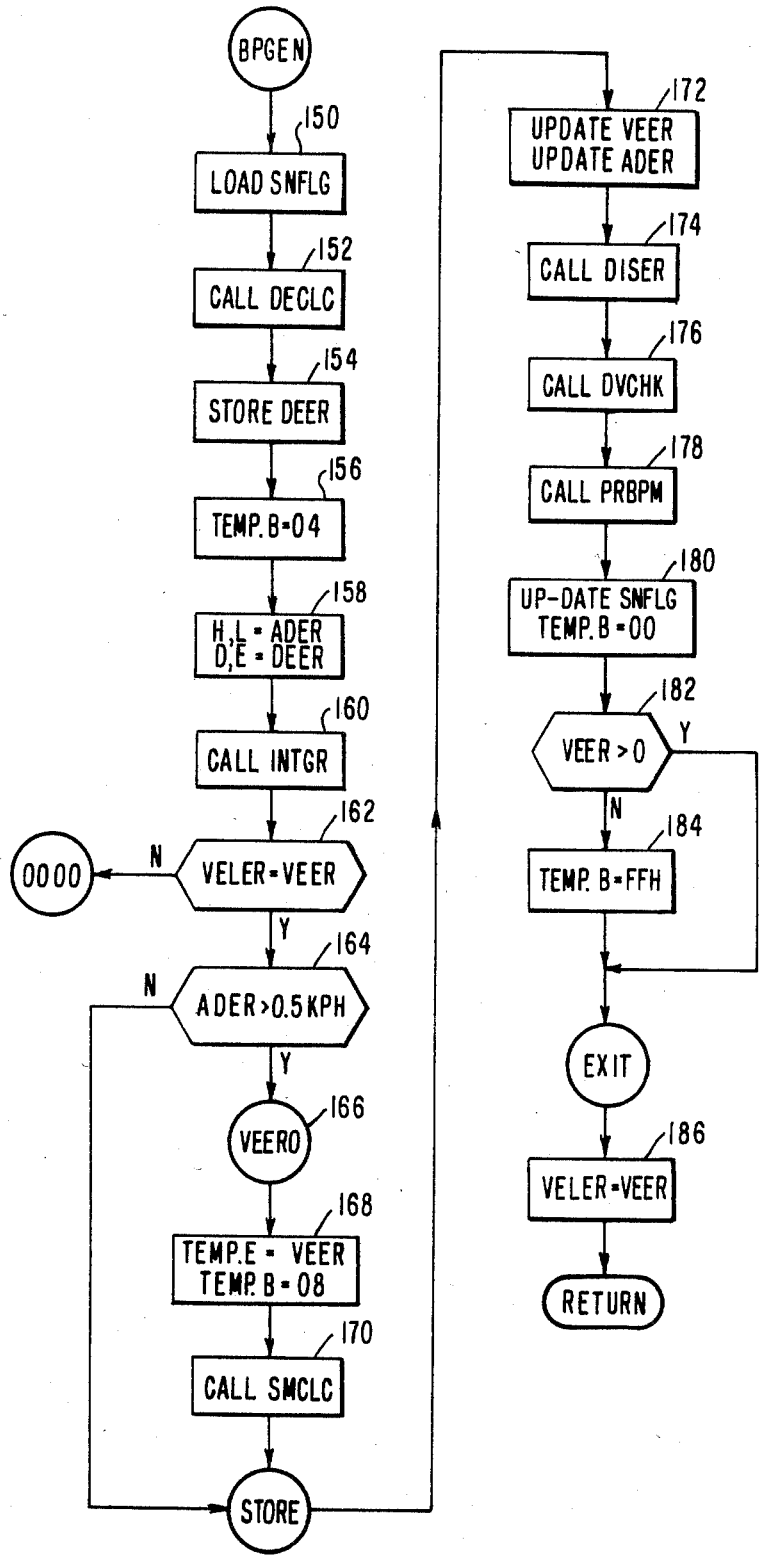
In FIGS. 11A, 11B, 11C, 11D, 11E,-11F and 11G there are shown flow charts to illustrate the BPM control program operation provided for the microprocessor brake control apparatus shown in FIG. 5.
Figure 11B:
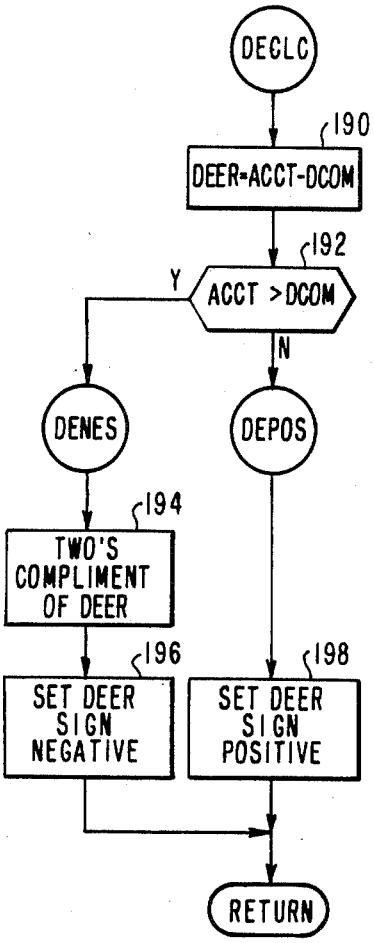
Figure 11C:
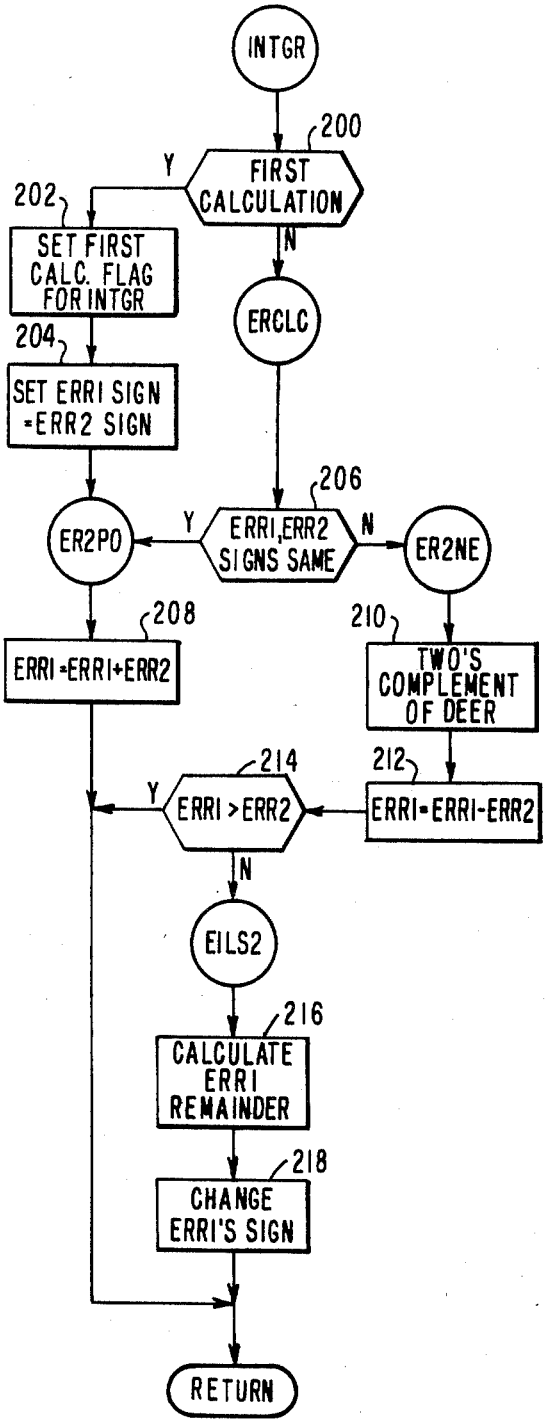
Figure 11D:
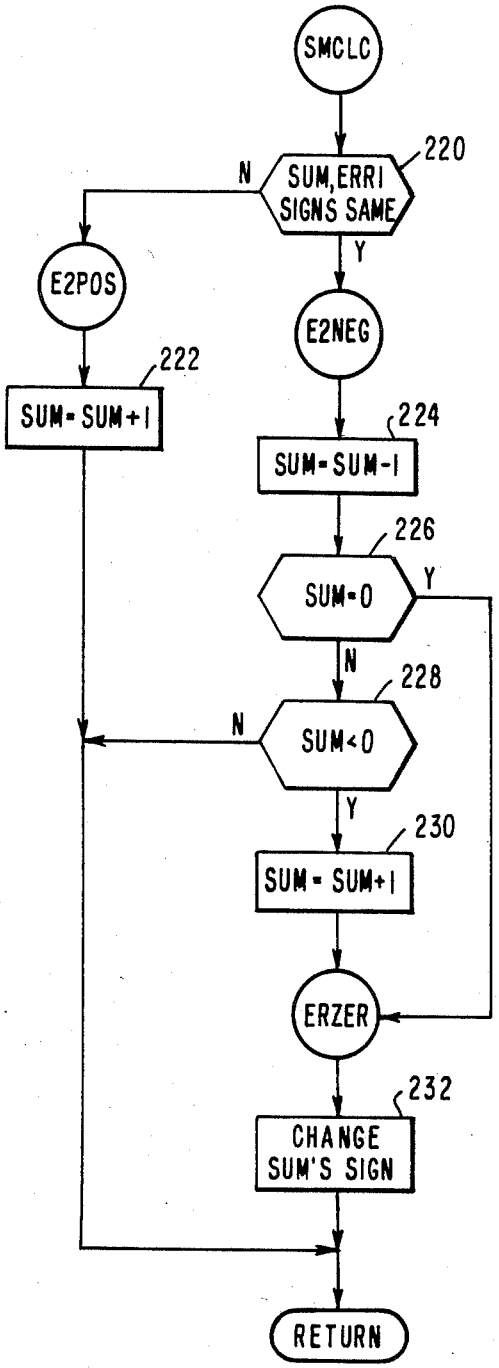
Figure 11E:
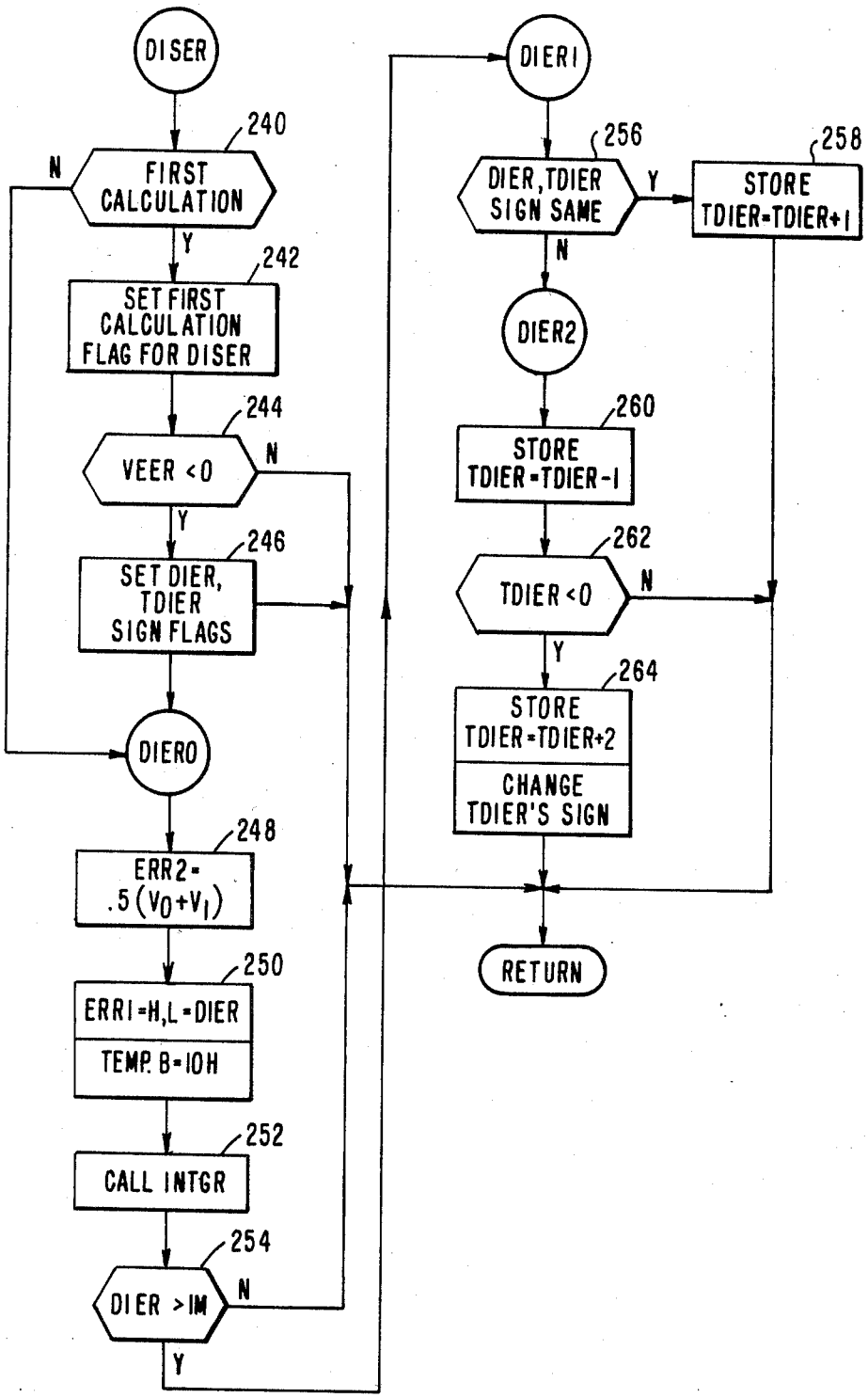
Figure 11F:
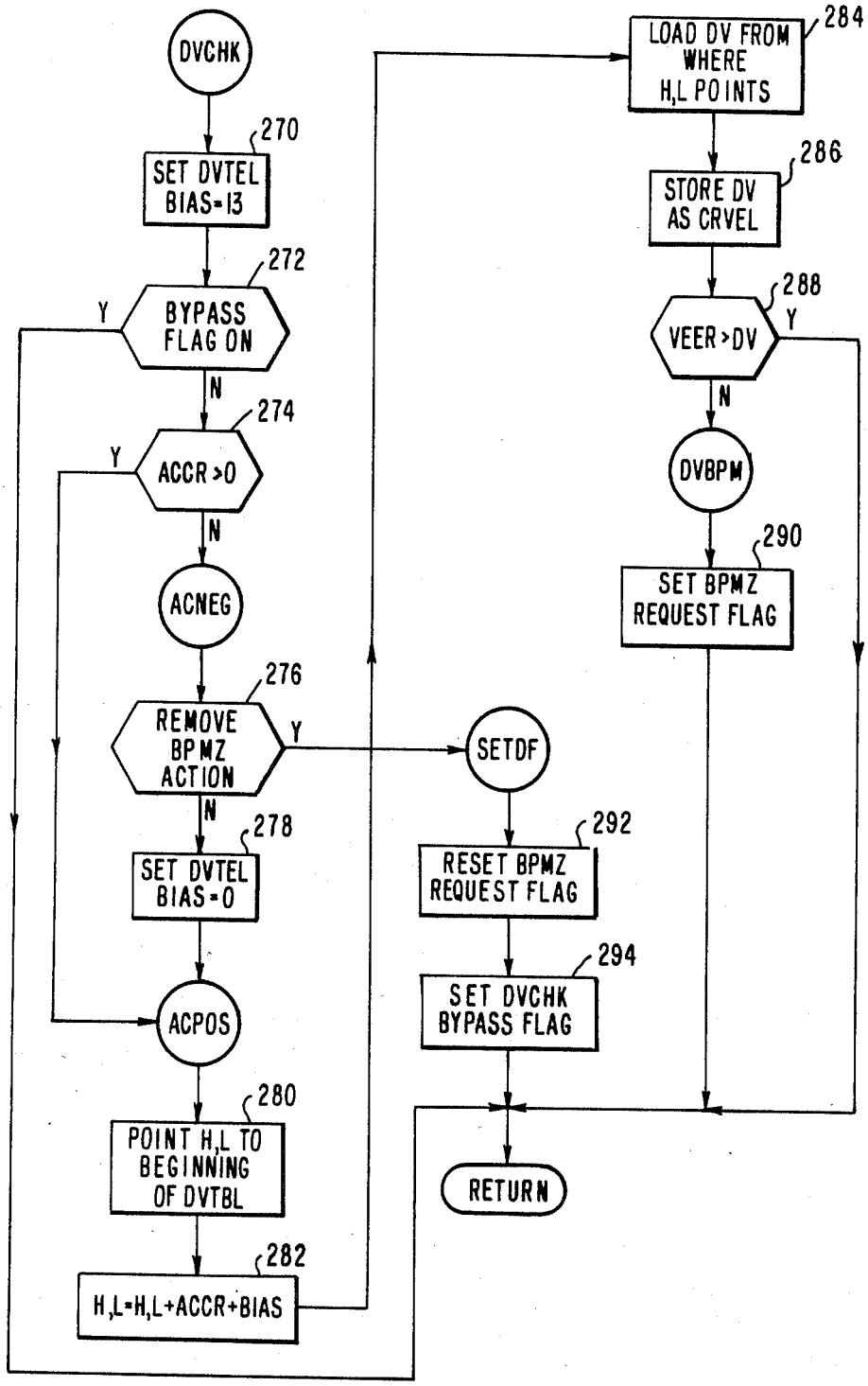
Figure 11G:
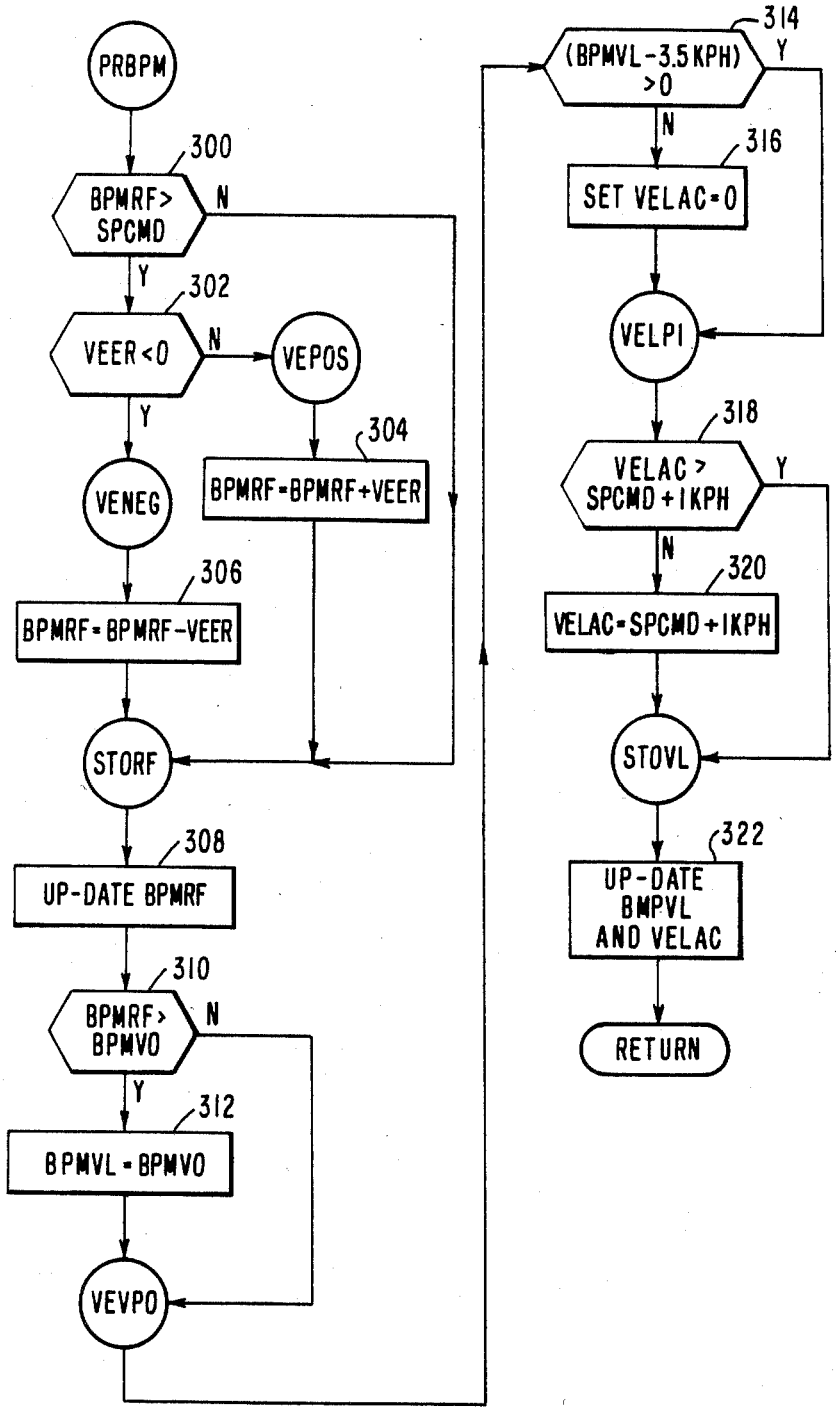

A flow chart is shown in FIG. 11A to illustrate the brake profile generator routine BPGEN, from which there are called the acceleration error subroutine DECLC shown in FIG. 11B, the acceleration error integration subroutine INTGR shown in FIG. 11C, the velocity error scaling correction subroutine SMCLC shown in FIG. 11D, the credit distance error determination subroutine DISER shown in FIG. 11E, the critical velocity check subroutine DVCHK shown in FIG. 11F, and the BPM profile generator subroutine PRBPM shown in FIG. 11G.

As shown in FIG. 11A, the BPGEN routine first calls the DECLC subroutine which calculates the acceleration error (DEER). Next, the INTGR subroutine is called which integrates the acceleration error (DEER) and returns the velocity error (ADER). ADER has a scaling of 162 bits/0.5 KPH and is a 16 bit variable to prevent overflow. A check between previously calculated doubly stored speed error (VEER and VELER) is done next, and if the variables do not contain the same value, the BPM control computer operation is reset while the emergency brakes 92 are applied to bring the train speed to zero. If ADER accumulates a value greater than or equal to 162 bits (0.5 KPH), the SMCLC subroutine is called, which adds or subtracts one bit out of the speed error (VEER) depending on the sign of ADER. If ADER is smaller than 162 bits the SMCLC routine is bypassed. Note that every time the SMCLC is called 162 bits are subtracted from the ADER variable. The next operation is to update the speed error (VEER) and the accumulated velocity error (ADER). The distance error subroutine (DISER) is called next, which calculates the credit distance to go as the total distance available to travel minus the distance travelled. Next, the critical velocity check subroutine (DVCHK) is called in order to get the train to flare in the BPM profile properly. Finally, the BPM profile generator subroutine (PRBPM) is called which generates all profiles necessary for the BPM operation.

At block 150 in FIG. 11A the sign flag SNFLG is loaded into a temporary register as part of setting up of a routine DECLC called at block 152 that will be explained later in relation to its own flow chart shown in FIG. 11B. At block 154 the value DEER which is the output of the DECLC routine is stored. As a part of setting up the next routine INTGR shown in FIG. 11C a few constants are loaded into some registers at blocks 156 and 158. These are previous values of ADER and DEER on the assumption that previous values stay at the same level for the duration of the 1/18 second cycle time. After the integration routine at block 160, at block 162 a check is made to see if two velocity errors are equal, and if they are not equal there is something wrong so the program returns to the beginning and reinitializes the overall control computer operation while the emergency brakes 92 are applied to bring the train to zero speed. If they are equal, this means the data has not changed in the memory, and at block 164 a check is made to see if ADER is greater than half a kilometer per hour. One half a kilometer per hour is a practical limit on the accuracy of the velocity error. If ADER is greater than 0.5 KPH, at block 168 some values are stored in registers as part of setting up another routine SMCLC shown in FIG. 11D which is called at block 170 and this is done since the integration routine output includes integers with fractional parts and for the desired accuracy this operation accumulates the fractions until they become a whole number. At block 172 both VEER and ADER are updated. At block 174 DISER is called, at block 176 DVCHK is called, at block 178 PRBPM is called. After calling these three routines in sequence, at block 180 the sign flag is updated and the under speed flag set (TEMPB=$\phi$). At block 182 a check is made to see if the velocity error is greater than zero. If the result of the comparison in block 182 is no, at block 184 the temporary register B is loaded with FFH indicating an overspeed condition. At block 186, the velocity error VFLER is set equal to VEER.

As shown in FIG. 11B, the DECLC subroutine called at block 152 implements the equation DEER=ACCT−DCOM, where DEER is the deceleration error, ACCT is the train acceleration, and DCOM is the deceleration command. The scaling of DEER is 65 bits/meter/sec$^2$. The scaling of ACCT and DCOM is 127 bits bias plus 65 bits/meter/sec$^2$ for negative acceleration, or minus 65 bits/meter/sec$^2$ for positive acceleration. All three variables are 8 bits long. If ACCT is greater than DCOM then the equation implemented is DEER=DCOM−ACCT by taking the two's compliments of the ACCT−DCOM result. The second bit on the sign flag is set if ACCT<DCOM (DEER negative), or reset if ACCT>DCOM (DEER positive). At block 190 the error in deceleration DEER is set equal to the train acceleration ACCT minus the deceleration command DCOM. The BPM profile 74 shows the desired acceleration of one meter per second squared, which can get modified depending on the track conditions and the number of brake failures and train conditions like that. This is an equation to be implemented, and the rest of this routine is a way of implementing it in relation to the limitations of an 8 bit Intel 8080 microprocessor. At block 192 a comparison is made of ACCT and DCOM. If ACCT is greater than the desired commanded deceleration then the subtraction will be negative, and at block 194 the twos complement value of DEER is taken and the sign flag is set to negative in block 196. If the comparison at block 192 was a yes, at block 198 the sign flag is set positive.

The next routine that is called at block 160 is the integration subroutine shown in FIG. 11C. The integration subroutine is used twice by the BPM program. Once for calculating the velocity error and again for calculating the distance error. Proper input variables must be given before the subroutine is called. Register B must contain the value to check for the first calculation by the subroutine. This value is 04H when the subroutine is called to calculate the velocity error and 10H for calculating the distance error.

In block 200 a check is made to see if this is the first time through the routine since it is desired to start the integration from zero, such that the integration does not start with an offset. If it is the first time, a flag is set at block 202 so the next time the result of this comparison will be negative and the next time it is not the first time so the integrator is not reset. At block 204 the error sign 1 is set equal to error sign 2, since the very first time there is no error and it is desired to start from zero so both of them are set equal to each other. And after that at block 208 error 1 is set equal to previous error 1 plus the new value of error 2. The error 1 is the accumulated value, and error 2 is the incremental value of this cycle time. Since this is the very first time through this subroutine both errors are assumed to be in the same direction. This first time is provided to set up the integrator. The next time through the loop subroutine, at the first block 200 the answer would be negative, and at block 206 a check is made to see if the sign of the present velocity error is the same as the previous output velocity error of the integrator. If their signs are the same, they are added up in block 208 and then an exit is made. If their signs are not the same, at block 210 the twos complement of the deceleration error DEER is taken and in block 212 the operation of subtraction is performed. Block 212 calculates the new output of the integrator. At block 214 a check is made to see if the new output is bigger than the previous output. Block 216 calculates any remainder and block 218 changes the sign flag and the integration routine is complete.

The next routine is SMCLC called at block 170 is shown in FIG. 11D and is for scaling correction. The SMCLC subroutine changes the scaling of the velocity error (ADER) calculated from the INTGR subroutine. The only input to the SMCLC subroutine is register B which is the byte necessary to check the sign flags of the input/output variables of SMCLC subroutine. If the signs of the velocity error ADER (ERR1) and output (SUM) variables are the same, the subroutine implements the equation SUM=SUM+1 and exits. Otherwise it implements the equation SUM=SUM−1. If the variable SUM is less than zero, it implements the equation SUM=SUM+1 and changes the sign of the SUM. If the variable SUM is equal to zero, then it changes the sign and exits. At block 220 a check is made to see if the signs are the same, and if they are block 222 adds one to the sum. If the signs are not the same, block 224 subtracts one from the sum. At block 226 a check is made to see if the new output sum equals zero. If it is equal to zero, at block 232, since it is zero it is now desired to start setting the sign of this error because the next time it will be the other way so a change is made in the sign of the error. If it is not zero at block 226, at block 228 a check is made to see if the sum is less than zero and if the answer is no, which means the sum is a positive number, the routine ends. If the sum is less than zero, at block 230 two units are added to the sum. The reason for that is if the velocity is over the BPM profile 74, it is desired for the velocity to start coming down to get under the profile 74 and then to become parallel with and under the profile 74. If this is not done, there is a possibility of the velocity 12 going over the profile 74 and then reaching the desired deceleration above the profile 74. Block 230 gets the velocity 12 under the profile 74 in relation to the desired profile deceleration rate that is known.

The next subroutine DISER is called at block 174 and is shown in FIG. 11E. The DISER subroutine calculates the credit distance shown in FIG. 10 using the trapezoidal integration rule. This is done using the average between two consecutive samples of the speed error (VEER) as an input to the integrator subroutines (INTGR). The distance error (DIER) calculated by the INTGR subroutine has a scaling of 132 bits/meter. The total distance error (TDIER) is calculated by doing a scaling correction. TDIER is incremented once every time DIER is equal to or greater than 132 bits. If it is the first time calculation at block 240, at block 242 a first time flag is set. At block 244 a check is made to see if the velocity error is less than zero. If it is not less than zero, the distance error and total distance sign flags are set. The first time is just a setting up time based on the velocity error. If it is not the first time at block 240, at block 248 error ERR2 is now determined as 0.5 times (V0 plus V1) where V0 and V1 are the present reading of velocity and the last reading of velocity, so this is the average velocity. The average velocity over a fixed period of time will give an indication of distance. At block 250 the new error ERR1 is loaded into registers H and L, and it is set equal to DIER. Also in block 250 the temporary register B is loaded with 10H which is a constant of integration. At block 252 the routine integration shown in FIG. 11C is called again. In block 254 a check is made to see if DIER is greater than a value one meter and if it is not, a return is made. If it is, then at block 256 a check is made to see if signs have changed. In block 258 if the signs are the same a value of one is added to TDIER. If all of the signs are not the same, block 260 subtracts one from TDIER and stores the result. At block 262 a check is made to see if the sign has changed. If it is not less than zero, there is no problem, so an exit is made. If it is less than zero then there is some problem, so block 264 adds 2 to TDIER. At block 264 the sign of TDIER is changed.

The next subroutine DVCHK is called at block 176 and is shown in FIG. 11F. This subroutine is executed only during the transient condition where the train merges into the BPM profile. After the flare in has been completed the DVCHK subroutine is bypassed. The bypass operation is done by checking on the bypass flag bit. If the bypass bit is set, that means that the train has reached the flare in acceleration level and from then on the subroutine is bypassed. During flare-in, the subroutine uses the non-linear function shown in FIG. 9 to decide which is the exact critical velocity that BPM 2 brake action has to be applied so the train will merge with the BPM profile 74 without overspeeding, and keeping a predetermined offset. The non-linear function plots speed error versus acceleration, and it is implemented in the software in the form of a table with 21 points for acceleration, and speed in 0.5 KPH increments. The subroutine compares the speed error calculated by the SMCLC subroutine against the speed error threshold from the table (DVTBL). If the speed error (VEER) is less than or equal to critical velocity CRVEL, BPM 2 action is requested by setting a bit in the sign flag. A table of all of the critical velocities versus acceleration is stored in memory in accordance with the relationship shown in FIG. 9. Block 270 sets the DV table bias equal to 13, which is a way of addressing the table. At block 272 a check is made to see if a bypass of the DV check operation is required, since the DV check is only active before the speed has merged in relation to the BPM profile 74. If the speed 12 is already in proper relationship to the profile 74 and the vehicle is decelerating at a desired rate there is no longer any need to determine a critical velocity. Upon a decrease change of the speed command, the BPM profile 74 starts coming down and the speed starts coming down because the speed error is becoming less and less and so less acceleration is requested. When the vehicle reaches the determined critical velocity where the brakes are set, the speed will merge into the BPM profile 74. A check is made to see if the bypass flag is on at block 272 and if the answer is yes, there already has been a DV check operation so the routine ends. If the bypass flag is not set, at block 274 a check is made to see if the acceleration is greater than zero. If the acceleration is less than zero and negative, at 276 a check is made to see if the BPM 2 brake action should be removed. When the deceleration rate reaches a value close to the commanded one (1 m/s$^2$) the open loop braking must be removed such that the delay of the system to return to closed loop control will provide enough braking to blend with the requested one without any overshoot. To do this the BPM 2 request flag is reset at stop 292 and the bypass flag is reset to indicate that the train has merged into the profile and that DV check will not be required again. If the BPM action should not be removed, the DV table bias is set to zero at block 278. At block 280, the acceleration is positive and the proper offset is provided and now it is required to calculate the address which is a displacement address, so H and L are loaded with the address at the beginning of the table, which is a pointer to the beginning. A bias to the table which is an offset is already provided, and now it is required to calculate a displacement which becomes the third thing that has to get added to the bias and the beginning of the table to come up with the absolute address of the data desired. Block 282 calculates the table address as H and L, the address of the beginning of the table, which is added to the acceleration value from the accelerometer plus the bias, which is either zero or 13, to pick the value off the table, and this value is stored at that H and L location. Block 284 loads DV from where H and L is pointing to, which is the critical velocity, and this critical velocity DV determines when the brakes are applied to merge into the BPM profile 74 and determines when to remove the brakes. At block 286 the critical velocity DV is stored as critical velocity. At block 288 a check is made to see if the velocity error, which is the difference between the BPM reference and the speed of the vehicle, is greater than the critical velocity delta V. If it is greater than critical velocity delta V, a return is made because there is no need for the brakes. If the velocity error is not greater than delta V which means the train speed error is too small for the given acceleration, then it is time to start braking in order to merge into the profile 74. At block 290 a flag is set which says apply BPM 2 brakes.

The next subroutine is PRBPM, which called at block 178 and is the profile generation subroutine shown in FIG. 11C. This subroutine generates three profiles, shown in FIG. 6 BPMRF, BPMVL, and VELAC. BPMRF is the BPM reference profile 74 which has a predetermined slope and starts 5.0 KPH above the former speed command. The equation implemented for calculating the BPM reference profile 74 is BPMRF=BPMRF+OR−VEER, depending on the sign of VEER. BPMVL is the BPM velocity profile which is equal to the former speed command (BPMVO) if BPMRF>BPMVO, otherwise, it is equal to the BPM reference profile (BPMRF). VELAC is the action velocity profile that is being outputted to the P.I. controller. The VELAC profile 79 shown in FIG. 6 is equal to the BPMVL profile minus a desired offset. To reduce the undershoot during the flare out transition from the VELAC profile to the new speed command, VELAC is clamped one KPH above the new speed command. All three profiles are updated during each execution of the subroutine. At block 300 a check is made to see if the BPM reference is bigger than the speed command to determine if the vehicle speed has gotten under the new speed command, which will eventually happen as a terminating condition where it is not desired to go below the new commanded speed. If yes, at block 302 a check is made to see the velocity error is less than zero, which is for the purpose of keeping track of the sign of the velocity error. If the velocity error is greater than zero, at block 304 the BPMRF is added to velocity error. If the velocity error is less than zero, at block 306 the velocity error is subtracted from the BPMRF. Either way the BPM reference is set equal to the previous BPM reference plus or minus the velocity error depending on the sign of the velocity error. The BPM reference is updated in block 308. The train is actually trying to follow this BPM profile, and the profile cannot terminate before the train speed is actually under the new speed command, so this subroutine operation occurs until the train actually comes below the new speed command and then the new speed command becomes the reference for speed maintaining. At block 310 a check is made to see if the BPM reference is greater than the BPM V0, which is a different level of BPM. If it is greater, at block 312 the BPM velocity is set equal to BPM V0. If the new BPM reference is not greater, then at block 314 there is subtracted 3½ KPH from BPMVL and a check is made to see if that value is greater than zero. If the 3½ KPH margin is not present, in block 316 VELAC is set equal to zero. This action velocity VELAC is used in the speed protection operation for the train in the automatic train control system including program stop and automatic speed maintaining. The action velocity VELAC when it is set equal to zero indicates no more velocity error and the train is at a desired speed. It is not desired for VELAC to go negative, so at block 318 a check is made to see if the action velocity is greater than the speed command plus 1 KPH. If it is, an update of the BPM velocity and action velocity is made at block 322 and return. If it is not, at block 320 VELAC is set equal to the speed command plus 1 KPH. This a clamping operation for VELAC in relation to a margin which is speed command plus 1 KPH. As the train speed comes down it is not desired for the train to undershoot the speed command, so VELAC is set at the speed command plus 1 KPH as a reference to ease off the brake and by the time there is any reaction from the train, the velocity understood is minimized and then the control operation follows the speed command. This allows the speed control operation to know when to terminate the BPM reference and follow the new speed command as a reference in speed maintaining.

Figure 12:
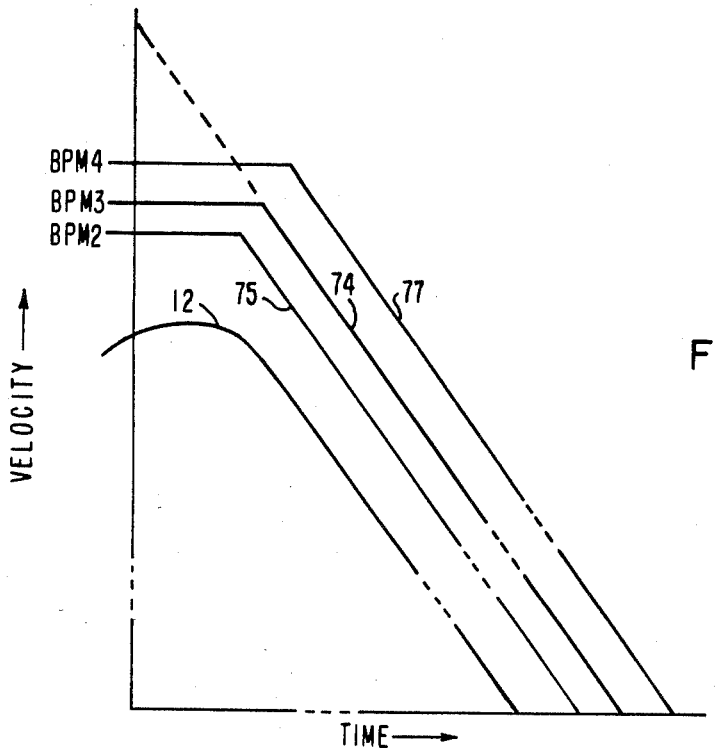
In FIG. 12 there is shown the present brake operation in relation to the vehicle speed merging below the BPM 2 brake operation curve.

In FIG. 12 there is shown a BPM brake control operation where the vehicle speed 12 smoothly merges as desired below the BPM 2 operation curve 75 such that the service brakes are removed and the normal speed maintaining control establishes a desired offset for the train speed from the BPM reference curve 74.

Figure 13:
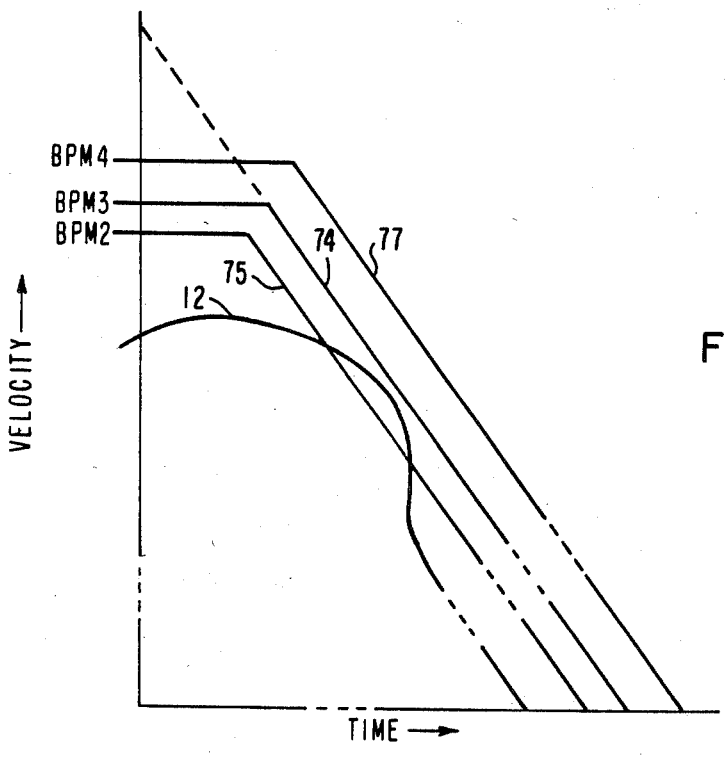
In FIG. 13 there is shown the present brake operation in relation to the vehicle speed overshooting the BPM 2 brake operation curve; and In FIG. 14 there is shown the present brake operation in relation to the vehicle overshooting the BPM 3 or reference brake operation curve.

In FIG. 13 there is shown a BPM brake control operation where the vehicle speed overshoots the BPM 2 curve 75. When the desired deceleration above the BPM 2 curve 75 is determined, the DUCHK operation provided by the subroutine shown in FIG. 11F is satisfied but the BPM 2 operation provided by comparator 114 is not satisfied so the service brakes 94 stay in operation until the vehicle speed 12 goes below the BPM 2 curve 75, with the normal speed maintaining then controlling the vehicle speed 12.

Figure 14:
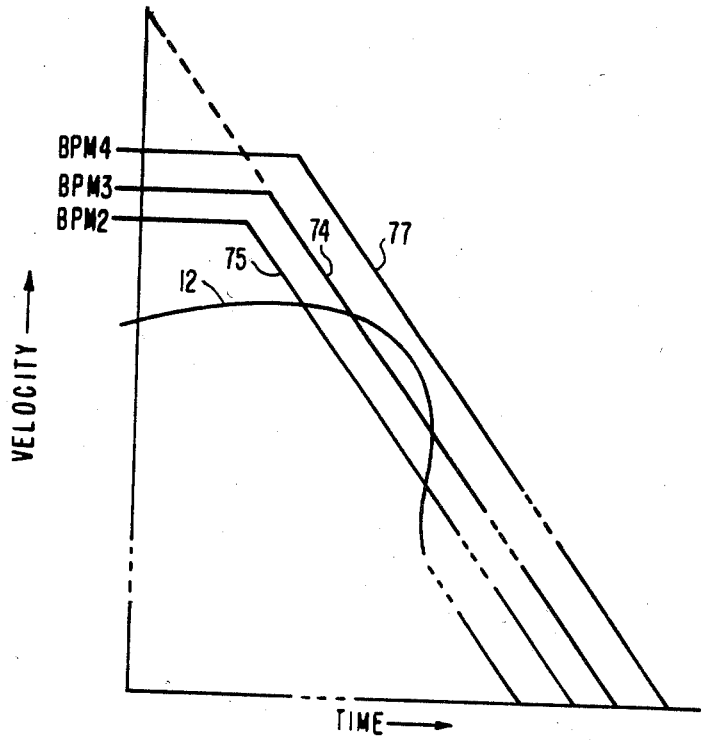

In FIG. 14 there is shown a BPM brake control operation where the vehicle speed 12 overshoots both the BPM 2 curve 75 and the BPM 0 or reference curve 74. The service brakes 94 are applied after the vehicle speed 12 goes above the BPM 2 curve 75, and the emergency brakes 92 are applied when the vehicle speed goes above the BPM reference curve 74. When the vehicle speed 12 goes below the BPM reference curve the comparator 112 removes the emergency brakes 92, and when the vehicle speed 12 goes below the BPM 2 curve 75 the comparator 114 removes the service brakes 94.

We claim:

1. In brake control apparatus for a vehicle operative with a roadway having a known system design first deceleration and having a command speed to establish the vehicle actual speed in relation to that roadway, the combination of means including an accelerometer coupled with the vehicle for sensing a second deceleration of the vehicle, means comparing the first deceleration and the second deceleration for determining a deceleration error of the vehicle, means responsive to a change of said command speed from a higher value to a lower value for determining a safe brake velocity for the vehicle in accordance with the actual speed and a velocity error established in relation to said deceleration error, and speed control means responsive to the safe brake velocity for controlling the actual speed of the vehicle until there is a predetermined relationship between the velocity error and a critical velocity established in relation to said second deceleration when the speed control means provides a deceleration of said vehicle in accordance with said velocity error.

2. The brake control apparatus of claim 1, with said speed control means providing said critical velocity as a predetermined function of the second deceleration for determining the deceleration of said vehicle.

3. The brake control apparatus of claim 1, with said speed control means comparing said critical velocity with the velocity error to select a predetermined deceleration operation of the vehicle.

4. The brake control apparatus of claim 1, with said velocity error determining one of a plurality of rates of said deceleration of said vehicle.

5. The brake control apparatus of claim 1, with the magnitude of said velocity error selecting one of a plurality of predetermined deceleration rates for said vehicle.

6. In the method of decelerating a vehicle operative with a roadway having a known safe deceleration rate and having a command speed to determine the vehicle travel speed along that roadway, the steps of sensing the actual acceleration of the vehicle, sensing a decrease in the command speed for providing a safe brake speed relationship in accordance with the vehicle travel speed and a velocity error established in relation to the safe deceleration rate and the vehicle acceleration;

providing a first operation of the vehicle in response to the safe brake speed relationship until a predetermined velocity error is established in relation to the known safe deceleration rate and said actual acceleration and providing a second operation of the vehicle after said predetermined velocity error is established and in accordance with a desired deceleration rate.

7. The vehicle decelerating method of claim 6, with the velocity error being established in relation to a difference between the safe deceleration rate and the vehicle actual acceleration to provide a deceleration error that establishes the velocity error.

8. The vehicle decelerating method of claim 6, with the second operation being provided in accordance with a comparison of the velocity error and at least one predetermined velocity difference in relation to the safe brake speed relationship.

9. The vehicle decelerating method of claim 6, with the second operation being determined by a comparison of the velocity error and at least one of a plurality of predetermined brake speed relationships including said safe brake speed relationship.

10. The vehicle decelerating method of claim 6, with the desired deceleration rate being greater than the known safe deceleration rate.

11. The vehicle decelerating method of claim 6, with the safe brake speed relationship having a deceleration rate in accordance with the known safe deceleration rate.

12. The vehicle decelerating method of claim 6, with the first operation being a closed loop control operation, and with the second operation being an open loop control operation.

* * * * *